United States Patent [19]

Snygg

[11] Patent Number: 4,944,467

[45] Date of Patent: Jul. 31, 1990

[54] METHOD AND APPARATUS FOR DECELERATING A JUMBO ROLL OF A PAPER OR BOARD MACHINE

[75] Inventor: Keijo K. Snygg, Karhula, Finland

[73] Assignee: A. Ahlstrom Corporation, Karhula, Finland

[21] Appl. No.: 19,617

[22] Filed: Feb. 27, 1987

[30] Foreign Application Priority Data

Feb. 27, 1986 [FI] Finland ..... 860835

[51] Int. Cl.[5] ..... B65H 18/16; B65H 19/30

[52] U.S. Cl. ..... 242/65; 242/75.4

[58] Field of Search ..... 242/56 R, 65, 75.4

[56] References Cited

U.S. PATENT DOCUMENTS

| | | | |
|---|---|---|---|
| 3,365,141 | 1/1968 | Soloduk | 242/65 X |
| 3,586,253 | 6/1971 | Gillbank | 242/65 |
| 3,877,654 | 4/1975 | Randpalu | 242/65 |
| 3,938,671 | 2/1976 | Lewey | 414/911 X |
| 3,957,221 | 5/1976 | Palovaara . | |
| 4,356,983 | 11/1982 | Weiss | 242/75.4 |
| 4,546,930 | 10/1985 | Rohde | 242/65 X |

FOREIGN PATENT DOCUMENTS

| | | |
|---|---|---|
| 2427466 | 6/1975 | Fed. Rep. of Germany . |
| 51463 | 9/1976 | Finland . |

*Primary Examiner*—Katherine A. Matecki

*Attorney, Agent, or Firm*—Nixon & Vanderhye

[57] ABSTRACT

The present invention relates to an apparatus for decelerating the jumbo roll of a paper or a board manufacturing machine in order to minimize the time required for a reel drum exchange and the amount of paper or board wasted as the jumbo roll slackens. The apparatus comprises brake shoes (9, 11) and arms (8) provided with means (13) producing the decelerating force. The arms can simultaneously transfer and decelerate the jumbo roll (2) whereby also a loop in the web is formed rapidly and easily.

15 Claims, 2 Drawing Sheets

METHOD AND APPARATUS FOR DECELERATING A JUMBO ROLL OF A PAPER OR BOARD MACHINE

FIELD OF INVENTION

The present invention relates to a method of decelerating the jumbo roll a paper of a board making machine during reel drum exchange and transfer of the jumbo roll. The invention further relates to an apparatus for carrying out the method in which decelerating apparatus is connected to the arms provided for transfer of a jumbo roll.

PRIOR ART

Prior art braking devices are disclosed for instance in DE patent specification No. 24 27 466 and FI patent specification No. 51463. The DE specification discloses an apparatus in which a brake drum disposed at both sides of the paper roll rotates with the roll. Brake levers connected by articulated joints at their lower ends to the bed are disposed on both sides of the brake drum. Brakes shoes, which are loaded against the drum by means of a pneumatic device arranged approximately in the middle of the levers, are connected to the upper ends of the brake levers via an articulated joint. Although the apparatus quickly stops the rotation of the jumbo roll, further measures still take time as the roll has to be transferred by a separated crane.

The Finnish patent specification discloses an apparatus for decelerating the winder of a paper or a board machine. The decelerating device mainly comprises a braking arm disposed by the side of the winder to move synchronously with the center of the reel drum which allows deceleration of the reel drum and the roll around it in any desired phase. The brake carriage comprises special coupling means for coupling the brake to the reel drum and brake means, i.e. a brake disc and brake blocks. The apparatus operates in the following way: the rotating velocity of the coupling means is accelerated to be almost the same as the rotational velocity of the new reel drum and when the rotational velocity of the jumbo roll has decelerated to be the same as the velocity of the coupling means, the coupling is attached to the drum. Then the rotation of the roll can be stopped at any desired moment by means of the braking means, i.e. by means of the brake disc and the brake blocks rotating with the coupling means. Although the device according to this patent specification facilitates many operations which have previously been very difficult to perform, is still is very complex, it requires electronics, electric motors etc. This involves very high costs. Further the apparatus requires a remarkably large space by the side of the winder.

As is described above, some parts and functions of both of these devices are not satisfactory. The apparatus of the DE specification, although it is simple, makes the reel drum exchange difficult. The decelerating apparatus according to the invention of the FI specification, which meets the operational requirements, has a complex structure and thus it is expensive and prone to disturbances.

DISCLOSURE OF INVENTION

To overcome these disadvantages, a new type of decelerating apparatus has been developed, which is based on the same principle as the apparatus of the DE specification, i.e. deceleration with friction surfaces which are connected to braking arms via articulated joints.

The apparatus according to the invention is further characterised by the feature that deceleration can be performed during the transfer of the jumbo roll. Other characteristic features of the invention are made apparent from the detailed description which follows.

Some of the advantages of the method and the apparatus according to the invention are for instance its very simple and inexpensive structure and the fact that the time required for the reel drum exchange is essentially shorter than by any prior art method or apparatus.

BRIEF DESCRIPTION OF DRAWINGS

The method and the apparatus according to the invention are further described below, by way of an example, with reference to the accompanying drawings in which.

DETAILED DESCRIPTION OF THE PREFERRED EMBODIMENT

Figure 1:
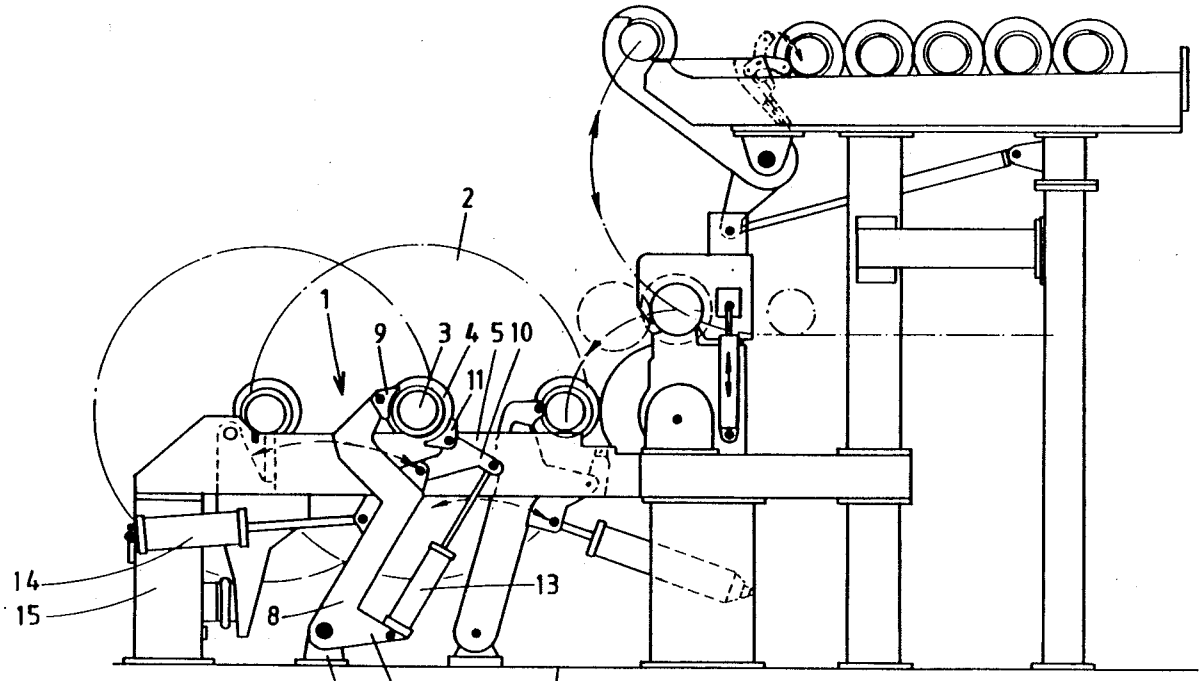
FIG. 1 is a general elevational view of the winder of a paper or a board manufacturing machine, illustrating the location of the decelerating apparatus according to the invention, in relation to the rest of the machinery.

In FIG. 1, decelerating apparatus 1 is located at the transfer device for the jumbo roll 2 (very large roll) of a paper of a board manufacturing machine. The numeral 2 refers to a finsihed jumbo roll which has been wound around a reel drum 3. Also, bearing housings 4, on which the jumbo roll is supported on rails 5, are provided at the ends of the reel drum 3.

Figure 2:
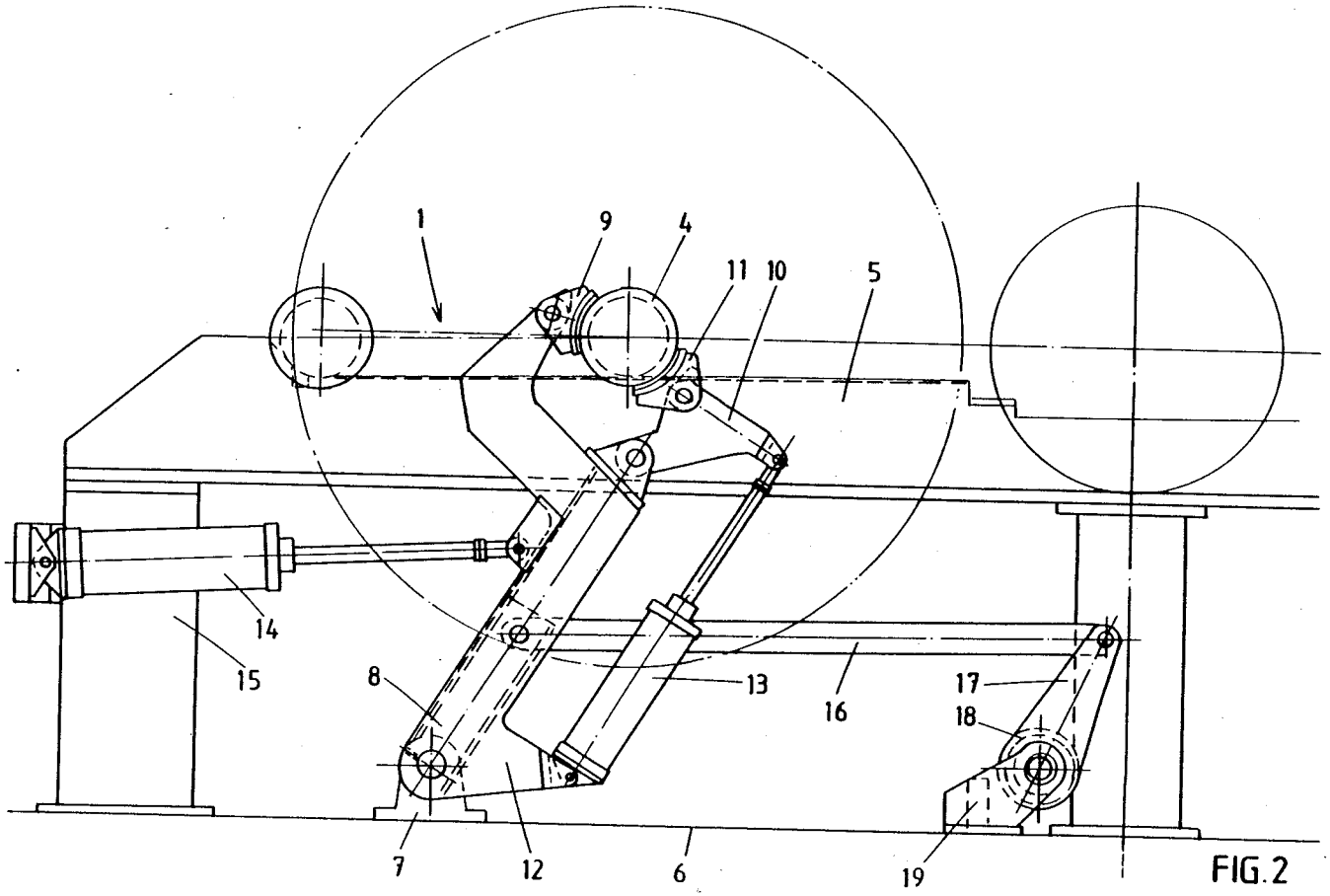
FIG. 2 is a detailed side view of a preferred embodiment of a decelerating apparatus according to the invention.

According to FIG. 2, the decelerating apparatus 1 is connected via an articulated joint (pivot) to a bracket 7, which is fixed to the bed. The decelerating apparatus itself comprises an arm 8, which is articulately connected to the bracket 7, and a brake shoe 9 swinging or pivotting in a vertical plane in the machine direction which shoe 9 is connected to the upper end of the arm 8 by an articulated joint or pivot connection. Also, a brake lever 10 is pivotally connected to the arm 8 and the other end of the lever 10 is provided with a brake shoe 11, which is substantially opposed to shoe 9 and which pivots in the machine direction. The length of the brake lever 10 and the arm 8 is chosen to make the brake shoe 11, which is pivotally connected to the brake lever 10, clearly reach to the paper machine side of the reel drum axis when the jumbo roll is finished. Further, the dimensioning is chosen so as to maintain the brake shoes 9, 11 in contact with the counter surface of the reel drum the whole time when the jumbo roll 2 rolls along the rails 5 to a position over the bracket 7, which bracket 7 is mounted on the bed. The brake lever 10 is connected to a bracket 12 of the arm 8 via a pressure medium cylinder 13 or a corresponding means by which the brake shoes 9, 11 are pressed towards or drawn away from each other.

Further, the arm 8 is connected via a pressure medium cylinder 14 or a corresponding means to a body construction 15. In the embodiment of FIG. 1, identical decelerating devices 1 are provided at both sides of the winder, which devices 1 preferably are connected to each other at the lower ends of their arms 8 with an adjusting rod disposed in the transverse direction of the winder. The embodiment of FIG. 2 may operate, if required, with only one transfer cylinder 14 as the arms 8 on the opposite sides of the winder are connected to each other via intermediate rods 16, levers 17 and an adjustment rod 18 which is disposed transverse under the winder. These means transmit a movement of the same size and direction as the movement of the arm 8, which is adjacent the cylinder 14, to the arm on the other side of the winder. The levers 17 are fixed by a rigid joint to the rod 18 and by an articulated or pivot joint to the bed 6 via a bracket 19.

The decelerating apparatus 1 operates in the following way. When a jumbo roll 2 is completed the brake shoes 9, 11 of the decelerating apparatus 1 contact the outer periphery of the end of the reel drum 3 or the casing surface of the reel drum thus decelerating the rotation of the jumbo roll 2. This action rapidly causes a web loop to be formed which is guided to be wound around a new reel drum. Subsequently the web is cut. At the same time and while deceleration continues, the transfer cylinder 14 is pressurized to pull the jumbo roll 2 away from the winder. Because the brake shoes 9, 11 are pivotally connected to the brake lever 10 and the arm 8, the jumbo roll 2 can roll along rails 5 on its bearing housings 4 while the brake shoes 9, 11 during the whole time thereof, sustain full contact with their counter surfaces. This operation minimizes the time required for a reel drum exchange and also reduces the amount of paper or board wasted during the deceleration phase.

A most important feature of the apparatus according to the invention is that articulation or pivoting of the brake shoes 9, 11 at the ends of the arms 8, 10 and the brake levers allows decelerating the jumbo roll already while it is being transferred. It is obvious to a person skilled in the art that the levers of the decelerating apparatus can be either by the inner or the outer side of the rails 5 or that either the casing surface of the reel drum 3 or the outer surface of a toothed coupling can be serve as the brake surfaces on the reel drum side. Further, if these surfaces for some reason can not be used as brake surfaces, it is possible to provide for instance specific friction surfaces, for example, on the outer surfaces of the toothed coupling, whereby the brake shoes would, of course, have no need for friction surfaces. The means 13 and 14 are in most cases pneumatic or hydraulic cylinders but they can be any means providing the same movement range. For example, the drive means 13 can in some applications be substituted by a lever arm articulated to the means 14 and connected to the brake lever 10, which produces the same operation as the means 13 in the described embodiment. Further the transfer cylinder 14 or the corresponding means can be used for handling of rolls of different size, i.e. rolls at different distances from the Pope cylinders.

The apparatus described above is only an advantageous illustrative embodiment of the apparatus according to the invention and it does not by any means limit the invention or its scope of protection which is defined by the appended patent claims.

I claim:

1. A method of decelerating and transferring a rotating jumbo roll associated with a paper or board manufacturing machine after a web has been completely wound about a reel drum to form said jumbo roll, comprising the steps of:

(a) providing a pair of pivotally mounted and substantially opposed brake shoes and causing said shoes to swing into engagement with brake surface means provided on said drum to decelerate rotation of the drum;

(b) actuating transfer means while said reel drum is rotating to move said jumbo roll in a direction perpendicular to its axis of rotation; and (c) continuing to apply said brake shoes to said brake surface means during said transfer means actuating step.

2. A method as defined in claim 1 wherein, as a result of causing the brake shoes to engage brake surface means provided on the drum, a loop is formed in the web which is thereafter guided to be wound about a new reel drum.

3. A method as defined in claim 2, wherein the actuating step is carried out by said transfer means causing said jumbo roll to roll along rails on bearing housings located at either end of said reel drum.

4. Apparatus for decelerating and transferring a rotating jumbo roll associated with paper or board manufacturing machine after a web has been completely wound about a reel drum to form said jumbo roll, said apparatus comprising:

(a) a pair of substantially opposed brake shoes for decelerating said rotating jumbo roll, said shoes carried by an arm pivotally mounted to a stationary support;

(b) means for moving said roll in a first direction perpendicular to its axis of rotation; and (c) means for enabling said brake shoes to continue to decelerate said roll while said roll is moved in said first direction.

5. Apparatus as defined in claim 4, and including means for mounting said reel drum for rolling movement on a pair of rails.

6. Apparatus as defined in claim 4, wherein a first of said brake shoes is pivotally mounted to said arm, and a second of said brake shoes is pivotally connected to a lever which is pivotally connected to said arm.

7. Apparatus as defined in claim 6, wherein said lever is further connected to a first drive means extending between said lever and a lower portion of said arm for actuating said brake shoes.

8. Apparatus as defined in claim 7, wherein a second drive means is connected between said arm and a fixed support for moving said reel drum and roll along a pair of rails in said first direction.

9. Apparatus as defined in claim 8, wherein the respective lengths of said arm and said brake lever are such that upon actuation of said first and second drive means, said brake shoes maintain decelerating contact with said reel drum during transfer movement of said reel drum and roll along said rails.

10. Apparatus as defined in claim 8, wherein said first and second drive means are fluid cylinders.

11. Apparatus as defined in claim 4, wherein said brake shoes are applied against at least one outer peripheral bearing surface of said reel drum.

12. Apparatus as defined in claim 11, wherein said outer peripheral bearing surface of said reel drum to which said brake shoes are applied is coated with a friction material.

13. A decelerating apparatus for reducing the rotational velocity of a jumbo roll produced in a paper or a board manufacturing machine during transfer movement of the roll, comprising support arm means having a pair of substantially opposed brake shoes pivotally mounted thereon, said support arm means being pivotally mounted to a fixed bed surface; said shoes engageable with brake surfaces provided on a reel drum supporting said roll; first drive means for effecting said engagement of said brake shoes; second drive means for pivotally displacing said support arm following engagement of said brake shoes; and means for mounting said brake shoes on said support arm such as to enable continued application of said brake shoes to the roll during said transfer movement of the roll.

14. Decelerating apparatus as defined in claim 13, wherein a first shoe of said pair of pivotally mounted directly to said support arm, and a second shoe of said pair is pivotally connected to a lever which is pivotally connected to said support arm.

15. Decelerating apparatus as defined in claim 14 and wherein said first drive means extends between said support arm and said lever and wherein said second drive means extends between said means and a fixed support.

* * * * *